US008305337B2

(12) United States Patent
Bae et al.

(10) Patent No.: US 8,305,337 B2
(45) Date of Patent: Nov. 6, 2012

(54) METHOD OF DRIVING A LIGHT SOURCE, DISPLAY APPARATUS FOR PERFORMING THE METHOD AND METHOD OF DRIVING THE DISPLAY APPARATUS

(75) Inventors: Jae-Sung Bae, Cheonan-si (KR); Jung-Hwan Cho, Goyang-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 463 days.

(21) Appl. No.: 12/471,799

(22) Filed: May 26, 2009

(65) Prior Publication Data

US 2010/0128024 A1 May 27, 2010

(30) Foreign Application Priority Data

Nov. 21, 2008 (KR) ..... 10-2008-0116055

(51) Int. Cl.
*G09G 3/36* (2006.01)

(52) U.S. Cl. ..... 345/102; 345/590

(58) Field of Classification Search ..... 345/87–104, 345/589, 590, 569, 603, 604; 382/162, 166, 382/167

See application file for complete search history.

(56) References Cited

U.S. PATENT DOCUMENTS

| | | | | |
|---|---|---|---|---|
| 2005/0140612 | A1* | 6/2005 | Baek | 345/83 |
| 2006/0038760 | A1* | 2/2006 | Aoki et al. | 345/89 |
| 2007/0279372 | A1* | 12/2007 | Brown et al. | 345/102 |
| 2008/0042968 | A1* | 2/2008 | Oh | 345/102 |
| 2008/0111502 | A1* | 5/2008 | Kim et al. | 315/294 |

FOREIGN PATENT DOCUMENTS

| | | |
|---|---|---|
| JP | 2007-322944 | 12/2007 |
| KR | 1020080044098 | 5/2008 |
| KR | 1020080078938 | 8/2008 |
| WO | WO 2007/143340 | 12/2007 |
| WO | WO 2008/035259 | 3/2008 |

OTHER PUBLICATIONS

European Office Action dated Jul. 28, 2011.

* cited by examiner

*Primary Examiner* — Amr Awad
*Assistant Examiner* — Aaron Midkiff
(74) *Attorney, Agent, or Firm* — F. Chau & Associates, LLC

(57) ABSTRACT

In method of individually driving a plurality of light-emitting blocks of a light source module providing light to a display panel including a unit pixel, luminance of a first light-emitting block corresponding to a first image block that includes an out of gamut (OOG) data among a plurality of image blocks corresponding to the light-emitting blocks is boosted. A second light-emitting block corresponding to a second image block that does not include the OOG data is driven so that the second light-emitting block has luminance corresponding to a representative gray-scale of the second image block.

19 Claims, 7 Drawing Sheets

METHOD OF DRIVING A LIGHT SOURCE, DISPLAY APPARATUS FOR PERFORMING THE METHOD AND METHOD OF DRIVING THE DISPLAY APPARATUS

CROSS REFERENCE TO RELATED APPLICATION

This application claims priority under 35 U.S.C. §119 to Korean Patent Application No. 2008-116055, filed on Nov. 21, 2008 in the Korean Intellectual Property Office (KIPO), the contents of which are herein incorporated by reference in their entirety.

BACKGROUND OF THE INVENTION

1. Field of the Invention

Exemplary embodiments of the present invention relate to a method of driving a light source, a display apparatus for performing the method, and a method of driving the display apparatus. More particularly, exemplary embodiments of the present invention relate to a method of driving a light source for improving display quality, a display apparatus for performing the method, and a method of driving the display apparatus.

2. Description of the Related Art

Generally, a liquid crystal display (LCD) apparatus includes an LCD panel displaying an image using am optical transmittance property of liquid crystal molecules and a backlight assembly disposed below the LCD panel to provide the LCD panel with light.

The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters.

The liquid crystal layer is interposed between the array substrate and the color filter substrate. When an electric field generated between the pixel electrode and the common electrode is applied to the liquid crystal layer, an arrangement of liquid crystal molecules of the liquid crystal layer is altered to change the optical transmissivity of the liquid crystal layer, so that an image is displayed on the LCD panel. The LCD panel displays a white image of high luminance when an optical transmittance is maximized, and the LCD panel displays a black image of low luminance when the optical transmittance is minimized.

An arrangement of the liquid crystal molecules of the liquid crystal layer may not be uniform, so that light leakage may be generated when the LCD panel displays an image having little gradation, e.g., in a fully black image. Thus, display quality of the fully black image may be deteriorated, so that the contrast ratio (CR) of an image displayed on the LCD panel may be decreased.

A method of local dimming of a light source has been developed to improve the contrast ratio of an image, which individually controls an amount of light according to a position at which the image is displayed to drive a light source. In the method of local dimming of the light source, the light source is divided into a plurality of light-emitting blocks, and the amount of light of the light-emitting blocks is controlled in correspondence with dark and bright areas of a display area of the LCD panel. For example, a light-emitting block corresponding to a display area displaying a black image is driven at low luminance (e.g., turned off), and a light-emitting block corresponding to a display area displaying a white image is driven at high luminance.

SUMMARY OF THE INVENTION

According to an exemplary embodiment of the present invention, in method of individually driving a plurality of light-emitting blocks of a light source module providing light to a display panel including a unit pixel, luminance of a first light-emitting block corresponding to a first image block that includes out of gamut (OOG) data among a plurality of image blocks corresponding to the light-emitting blocks is boosted. A second light-emitting block corresponding to a second image block that does not include the OOG data is driven so that the second light-emitting block has luminance corresponding to a representative gray-scale of the second image block.

According to another exemplary embodiment of the present invention, a display apparatus includes a light source module, a display panel and a light source module driving part. The light source module includes a plurality of light-emitting blocks. The display panel includes a unit pixel that comprises red, green, blue and white pixels, and displaying an image divided into a plurality of image blocks corresponding to the light-emitting blocks. The light source module driving part boosts luminance of a first light-emitting block corresponding to a first image block that includes an out of gamut (OOG) data among the image blocks, the OOG data being out of a displayable data range of the display panel.

According to still another exemplary embodiment of the present invention, in method of driving a display apparatus, including a display panel including a unit pixel that comprises red, green, blue and white pixels and a light source module individually driving a plurality of light-emitting blocks, an input data is compared with a reference value to determine whether the input data is an out of gamut (OOG) data that is out of a displayable data range of the display panel is determined, the input data including red, green and blue gray-scales. A luminance of a first light-emitting block corresponding to a first image block that includes the OOG data among a plurality of image blocks corresponding to the light-emitting blocks is boosted. A gray-scale of the first image block, except for the OOG data, is corrected so that an image displayed by the corrected gray-scale has an original, pre-boosted, luminance. The OOG data and the corrected gray-scale of the first image block are displayed on the display panel.

According to some example embodiments of the present invention, in the display apparatus including the unit pixel comprising the red, green, blue and white pixel, the luminance of the light-emitting block corresponding to the image block including the OOG data is boosted up so that the display apparatus may display the OOG data.

BRIEF DESCRIPTION OF THE DRAWINGS

The present invention will become more apparent by describing in detailed exemplary embodiments thereof with reference to the accompanying drawings, in which.

DETAILED DESCRIPTION OF THE INVENTION

Figure 1:
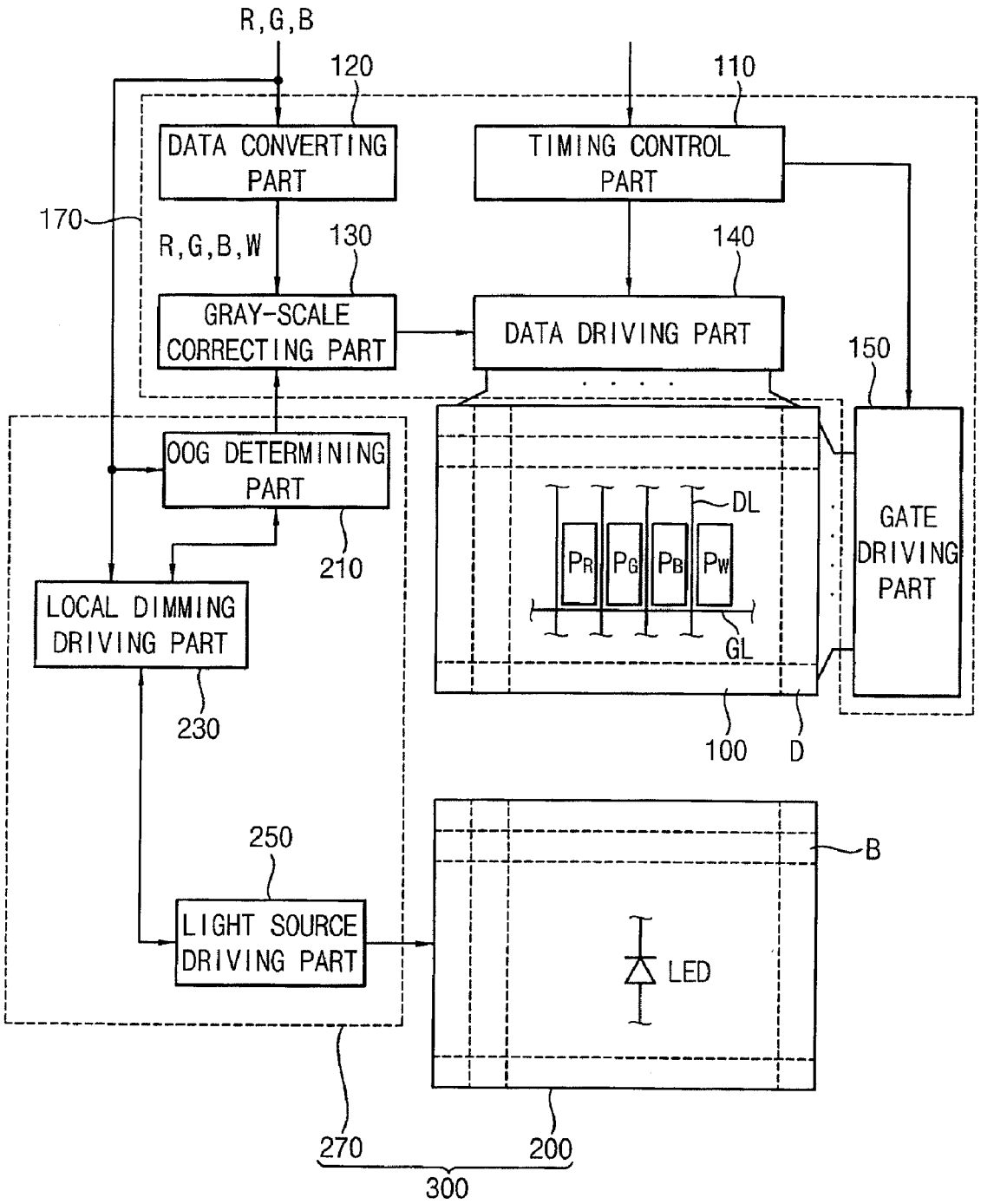
FIG. 1 is a block diagram illustrating a display apparatus according to an embodiment of the present invention.

The present invention is described more fully hereinafter with reference to the accompanying drawings, in which exemplary embodiments of the present invention are shown. The present invention may, however, be embodied in many different forms and should not be construed as limited to exemplary embodiments set forth herein. Rather, exemplary embodiments are provided so that this disclosure will be thorough and complete, and will fully convey the scope of the present invention to those skilled in the art. In the drawings, the sizes and relative sizes of layers and regions may be exaggerated for clarity.

The terminology used herein is for the purpose of describing particular example embodiments only and is not intended to be limiting of the present invention.

Hereinafter, the present invention will be explained in detail with reference to the accompanying drawings.

FIG. 1 is a block diagram illustrating a display apparatus according to an embodiment of the present invention.

Referring to FIG. 1, the display apparatus includes a display panel 100, a panel driving part 170 and a light source apparatus 300.

The display panel 100 includes a plurality of data lines DL, a plurality of gate lines GL crossing the data lines DL and a plurality of unit pixels. Each of the unit pixels comprises red, green, blue and white pixels, $P_R$, $P_G$, $P_B$ and $P_W$, respectively. Each of the red, green, blue and white pixels includes a switching element TR connected to the gate line GL and the data line DL, a liquid crystal capacitor CLC connected to the switching element TR, and a storage capacitor CST connected to the liquid crystal capacitor CLC.

Figure 2:
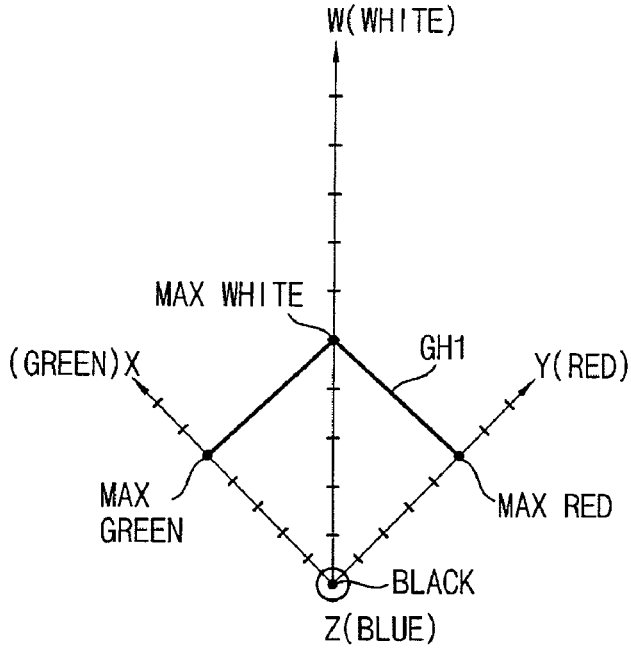
FIG. 2 is a graph illustrating a color area that is displayed in a unit pixel of an RGB structure comprising red, green and blue pixels of the display panel of FIG. 1.
Figure 3:
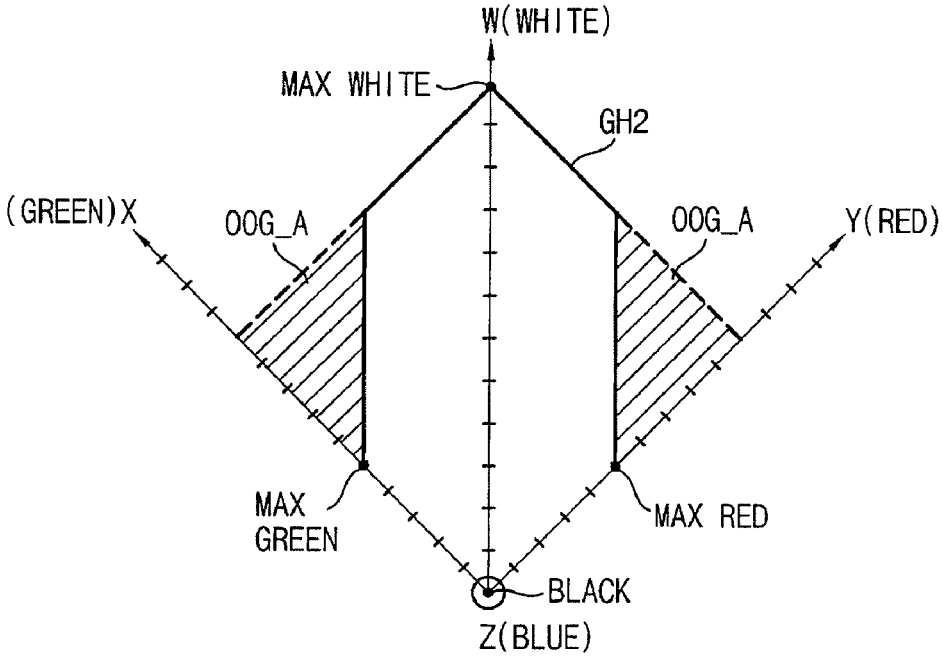
FIG. 3 is a graph illustrating a color area that is displayed in a unit pixel of an RGBW structure comprising red, green, blue and white pixels of the display panel of FIG. 1.

FIG. 2 is a graph illustrating a color area displayed in a unit pixel of an RGB structure comprising red, green and blue pixels of the display panel of FIG. 1. FIG. 3 is a graph illustrating a color area displayed in a unit pixel of an RGBW structure comprising red, green, blue and white pixels of the display panel of FIG. 1.

Referring to FIGS. 2 and 3, an X-axis indicates a green luminance, a Y-axis indicates a red luminance and a Z-axis perpendicularly extending from a crossing point of the X-axis and the Y-axis indicates a green luminance. A W-axis extending between the x-axis and the Y-axis indicates a white luminance. The graph of the RGB structure is defined as a first display area GH1, and the first display area GH1 is a whole area (Gamut Hull) of color (a subset of colors) displayed by using the red, green and blue luminance. The first display area GH1 is determined by maximum values of the red, green and blue luminance. The graph of the RGBW structure is defined as a second display area GH2, and the second display area GH2 is a whole area (Gamut Hull) of color displayed by using the red, green, blue and white luminance. The second display area GH2 is determined by maximum values of the red, green, blue and white luminance. The maximum value of the white luminance in the RGBW structure is about a twice of the maximum value of the white luminance in the RGB structure.

The RGBW structure may have a high resolution in comparison with the RGB structure relative to the same number of the color pixels. The RGBW structure has a high transmissivity so that the same luminance may be obtained at low electric power in comparison with the RGB structure. However, the RGBW structure includes an out of gamut (OOG) area OOG_A. The OOG area OOG_A includes an OOG color that is a saturated color that does not include the white color. Thus, the unit pixel of the RGBW structure does not display the OOG color. Hereinafter, a method of displaying the OOG color of OOG area OOG_A will be explained with reference to the light source apparatus according to an exemplary embodiment.

The light source apparatus 300 includes the light source module 200 and the light source module driving part 270. The light source module 200 includes a printed circuit board (PCB) and a plurality of light sources disposed on the PCB. The light source module 200 includes red, green and blue light sources. The light source module 200 is divided into I×J (wherein I and J are natural numbers) light-emitting blocks B. The light-emitting blocks B may be individually driven corresponding to an image displayed on the display panel 100 in a local driving mode. Each of the light-emitting blocks B may comprise a plurality of white light sources. Each of the light-emitting blocks B may comprise red, green and blue light sources. The light source may include an emitting light diode (LED).

The light source module driving part 270 includes an OOG determining part 210, a local dimming driving part 230 and a light source driving part 250. The light source module driving part 270 drives the light-emitting blocks B of the light source module 200 to boost luminance of the light-emitting blocks B. Therefore, the OOG color of the OOG area OOG_A may display in the RGBW structure.

The OOG determining part 210 compares an input data with a reference value to determine whether an input data is an OOG data. The input data includes red, green and blue gray-scales.

For example, the OOG determining part 210 converts the red, green and blue gray-scales corresponding to the unit pixel to red, green and blue luminance values. The OOG determining part 210 determines the OOG data of the OOG area OOG_A when a minimum of the red, green and blue luminance values is lower than a low reference value and a maximum of the red, green and blue luminance values is higher than a high reference value. Otherwise, the OOG determining part 210 converts the red, green and blue gray-scales to red, green, blue and white gray-scales, and converts the red, green, blue and white gray-scales to red, green, blue and white luminance values. The OOG determining part 210 may determine the OOG data when the minimum of the red, green, blue and white luminance values is lower than a low reference value and the maximum of the red, green, blue and white luminance values is higher than a high reference value.

The local dimming driving part 230 divides the image signal into a plurality of image blocks D corresponding to the light-emitting blocks B, and generates control signals controlling luminance of the respective light-emitting blocks by using the gray-scales. For example, the local dimming driving part 230 drives a first light-emitting block corresponding to a first image block having the OOG data among the image blocks D so that the first light-emitting block boosts the maximum luminance. The local dimming driving part 230 drives a second light-emitting block corresponding to a second image block not having the OOG data among the image blocks D so that the second light-emitting block emits a luminance corresponding to a representative gray-scale of the second image block.

The local dimming driving part 230 adjusts a duty ratio of a driving signal that drives the first light-emitting block to maximum, or adjusts a peak current of the driving to maximum. The local dimming driving part 230 may also adjust a duty ratio (a ratio of a pulse duration and period) and a peak current of the driving signal to a maximum.

The local dimming driving part 230 provides the light source driving part 250 with the control signals that control luminance of the light-emitting blocks B, for example, the control signals include duty data controlling the duty ratio of the driving signal and a current level data controlling the peak current of the driving signal.

The light source driving part 250 generates the driving signal by using the duty data and the current level received from the local dimming driving part 230. The light source driving part 250 provides the light-emitting blocks B of the light source module 200 with the driving signals to drive the light-emitting blocks B.

The panel driving part 170 includes a timing control part 110, a data converting part 120, a gray-scale correcting part 130, a data driving part 140 and a gate driving part 150.

The timing control part 110 receives an external synchronization signal. The timing control part 110 generates a timing control signal by using the external synchronization signal. The timing control signal includes a clock signal, a horizontal start signal and a vertical start signal, etc.

The data converting part 120 converts the input data corresponding to the display panel 100 of the RGBW structure. For example, the data converting part 120 converts the red, green and blue gray-scales to the red, green, blue and white gray-scales.

The gray-scale correcting part 130 corrects gray-scales of the first image block that includes the OOG data. For example, the gray-scale correcting part 130 decreases a level of a remainder gray-scale of the first image block except for the OOG data. The first image block is provided with light boosted to the maximum luminance so that an image displayed using the remaining gray-scale may have an original, pre-boosted, luminance. For example, when the first image block is provided with light boosted by twice an original luminance, the remaining gray-scale is corrected to one-half a level of the remaining gray-scale. Therefore, the remaining gray-scale corrected to the low gray-scale may display an original, pre-boosted, image.

The driving part 140 drives the data line DL by using a data control signal received from the timing control part 110 and the gray-scale received from the gray-scale correcting part 130. The driving part 140 converts the gray-scale to an analog data voltage output the data line DL.

The gate driving part 150 drives the gate line GL by using a gate control signal received from the timing control part 110. The gate driving part 150 outputs a gate signal to the gate line GL.

Figure 4:
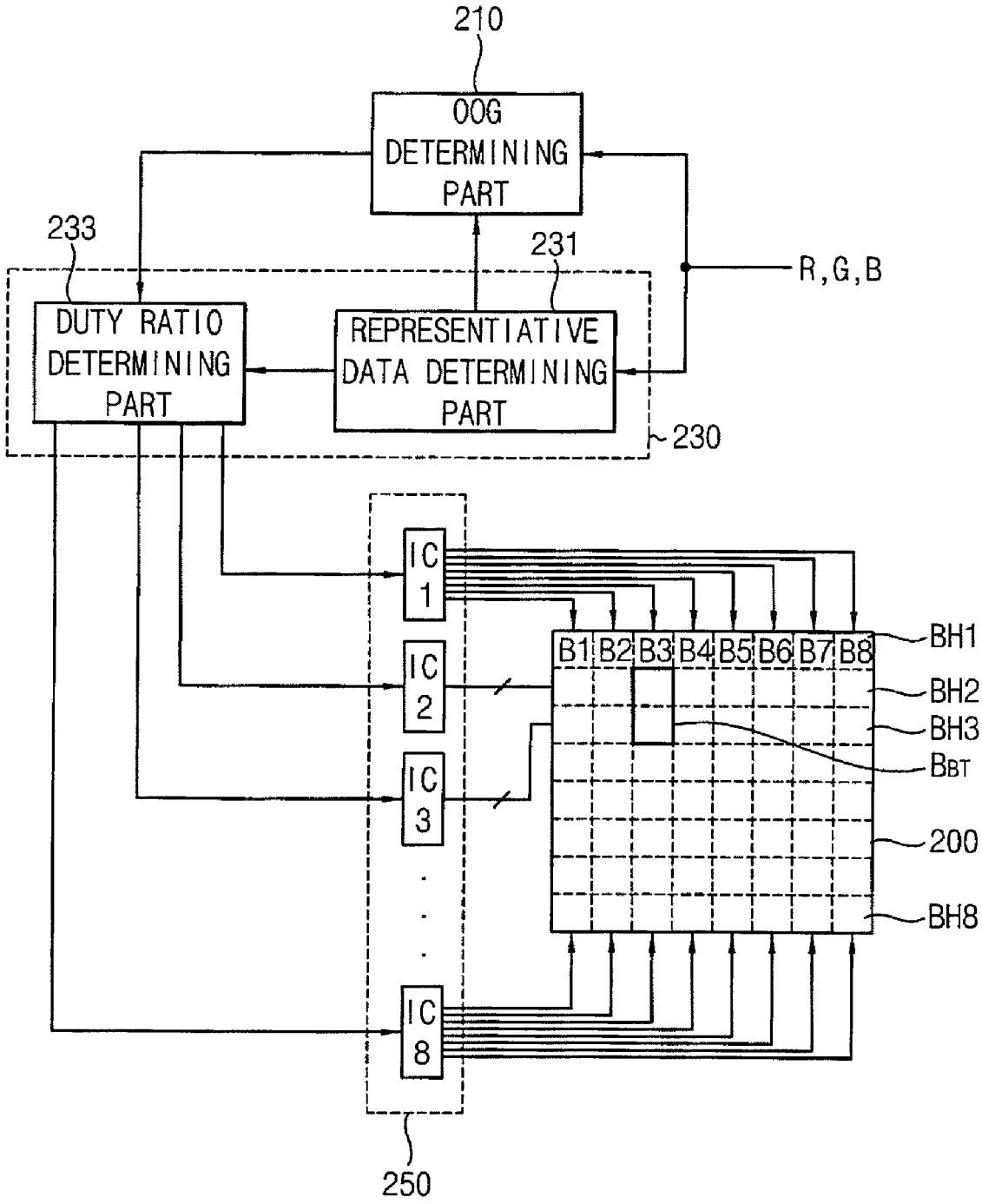
FIG. 4 is a block diagram illustrating the light source apparatus of FIG. 1.

FIG. 4 is a block diagram illustrating the light source apparatus of FIG. 1.

Referring to FIGS. 1 and 4, the light source apparatus 300 includes a light source module 200, an OOG determining part 210, a local dimming driving part 230 and a light source driving part 250.

The light source module 200, for example, is divided into a plurality of light-emitting blocks B forming an 8×8 matrix structure, and the light-emitting blocks comprise 8 driving blocks BH1, BH2, BH3, . . . , BH8. Each driving block, e.g., BH1, includes 8 light-emitting blocks B1, B2, B3, . . . , B8.

The OOG determining part 210 converts the red, green and blue gray-scales R, G and B of the unit pixel to the red, green and blue luminance values. The OOG determining part 210 determines the OOG data of the OOG area OOG_A when the minimum of the red, green and blue luminance values is lower than a low reference value and the maximum of the red, green and blue luminance values is higher than a high reference value.

The local dimming driving part 230 includes a representative data determining part 231 and a duty ratio determining part 233.

The representative data determining part 231 divides the input data comprising the red, green and blue gray-scales into a plurality of image blocks D corresponding to the light-emitting blocks B. The representative data determining part 231 determines representative gray-scales of the red, green and blue gray-scales. For example, the representative gray-scale may be average gray-scale, a maximum gray-scale, etc. The representative data determining part 231 determines representative gray-scales by using the red, green and blue gray-scales of the image block when the light-emitting block B is comprised the red, green and blue light sources, and determines a representative gray-scale of the white color when the light-emitting block B is comprised of the white light sources.

The duty ratio determining part 233 determines the duty data that controls luminance of the light-emitting block B. For example, the duty ratio determining part 233 determines the duty ratio of the first light-emitting block corresponding to the first image block including the OOG data to maximum duty ratio. The duty ratio determining part 233 determines the duty ratio of the second light-emitting block corresponding to the second image block not including the OOG data to a predetermined duty ratio that corresponds to the representative gray-scale of the second image block.

The light source driving part 250 includes a plurality of driving circuits. For example, the light source driving part 250 includes first to eighth driving circuits IC1, IC2, . . . , IC8 corresponding to the 8 driving blocks BH1, BH2, . . . , BH8. A first driving circuit IC1 includes 8 output channels, and provides the light-emitting blocks B1, B2, B3, . . . , B8 of a first driving bock BH1 with the driving signals.

For example, when second and third driving blocks BH2 and BH3 correspond to the first image blocks BBT including the OOG data, second and third driving circuits IC2 and IC3 provide the first light-emitting blocks BBT with maximum duty ratios received from the local dimming driving part 230. Thus, the second and third driving circuits IC2 and IC3 drive the first light-emitting blocks BBT using the maximum duty ratios so that the first light-emitting blocks BBT are boosted to the maximum luminance.

Figure 5:
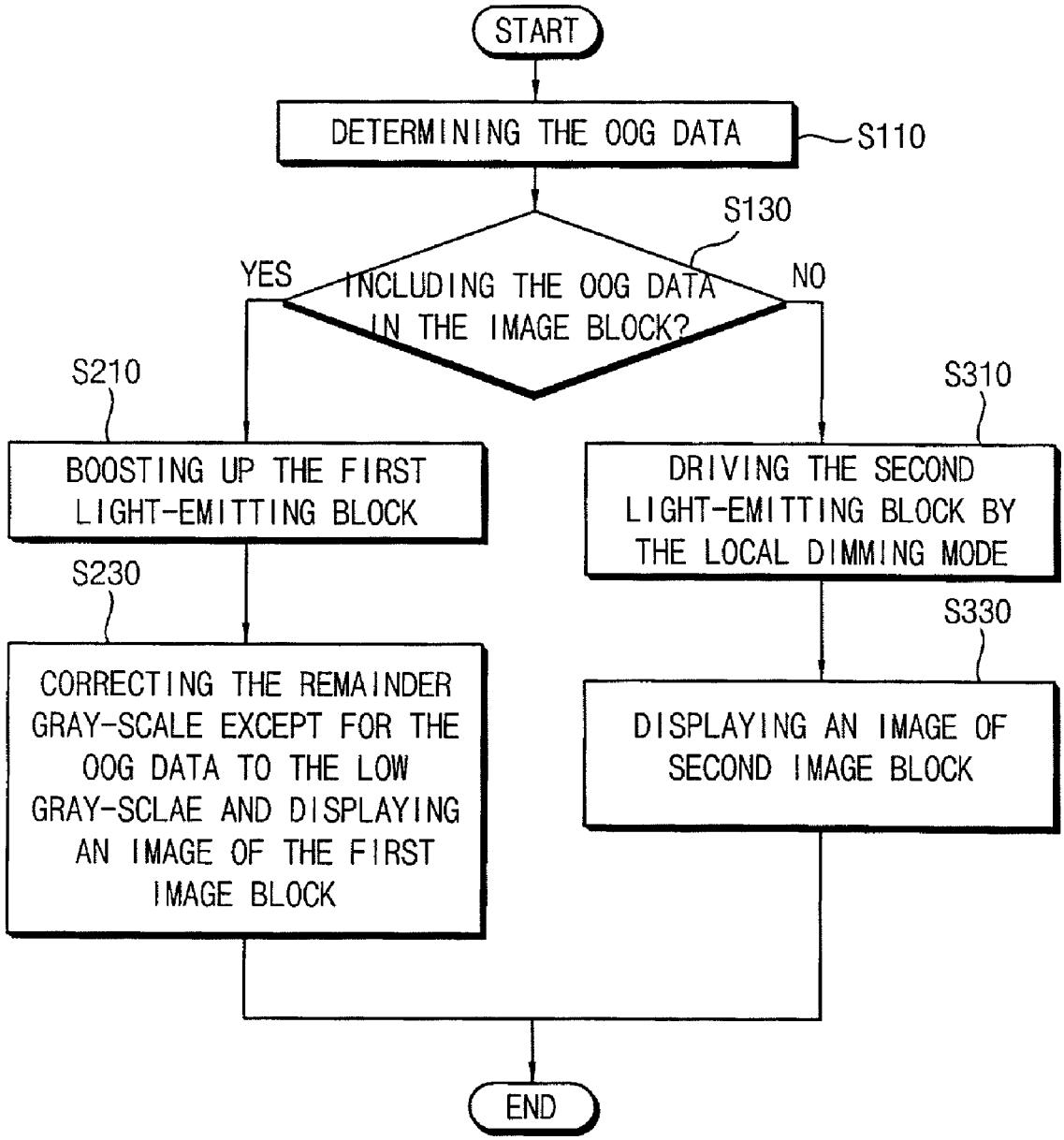
FIG. 5 is a flowchart illustrating a method of driving the display apparatus of FIG. 1.

FIG. 5 is a flowchart illustrating a method of driving the display apparatus of FIG. 1.

Referring to FIGS. 1, 4 and 5, the OOG determining part 210 compares the input data with the reference value, and determines whether the input data is the OOG data including the OOG area (block S110). For example, the OOG determining part 210 converts the red, green and blue gray-scales (R, G and B) to the red, green and blue luminance values. The OOG determining part 210 determines the input data to be the OOG data when the minimum of the red, green and blue luminance values is lower than the low reference value and the maximum of the luminance red, green and blue luminance values is higher than the high reference value. Otherwise, the OOG determining part 210 converts the red, green and blue gray-scales (R, G and B) of the input data to the red, green, blue and white gray-scales (R, G, B and W), and converts the red, green, blue and white gray-scales to the red, green, blue and white luminance values. The OOG determining part 210 compares the red, green, blue and white luminance values with the reference value to determine whether the input data is the OOG data.

The local dimming driving part 230 distinguishes the first and second image blocks from the image blocks by using information provided from the OOG determining part 210 (block S130). For purposes of explanation, assume that the first image block includes the OOG data and that the second image block does not include the OOG data.

The local dimming driving part 230 controls the first light-emitting block corresponding to the first image block to boost the luminance of the first light-emitting block corresponding to the first image block to the maximum luminance. The local dimming driving part 230 controls the light source driving part 250 so that the luminance of the first light-emitting block is boosted to the maximum luminance (block S210).

The gray-scale correcting part 130 corrects the remainder gray-scales of the first image block except for the OOG data to low gray-scales. The data driving part 140 converts the corrected gray-scale and the OOG data of the first image block to analog data voltages. The data driving part 140 outputs the analog data voltages to the display panel 100 (block S230). The level of the remainder gray-scales of the first image block is decreased to the low gray-scales so that the remainder gray-scales having the low gray-scale may display an image at an original luminance although light of the maximum luminance is irradiated onto the first image block. Thus, an image of the first image block is displayed on the display panel 100.

The local dimming driving part 230 controls the second light-emitting block corresponding to the second image block to drive the second light-emitting block to have the luminance based on the representative gray-scale of the second image block. The local dimming driving part 230 controls the light source driving part 250 so that the luminance of the second light-emitting block is driven to have the luminance corresponding to the representative gray-scale (block S310).

The gray-scale correcting part 130 dose not correct the gray-scales of the second image block to provided to the data driving part 140. The gray-scale correcting part 130 may correct the gray-scales of the second image block based on the representative gray-scale of the second image block. The data driving part 140 converts the gray-scales of the second image block to analog data voltages and provides the analog data voltages to the display panel 100 (block S330). Thus, an image of the second image block is displayed on the display panel 100.

Figure 6:
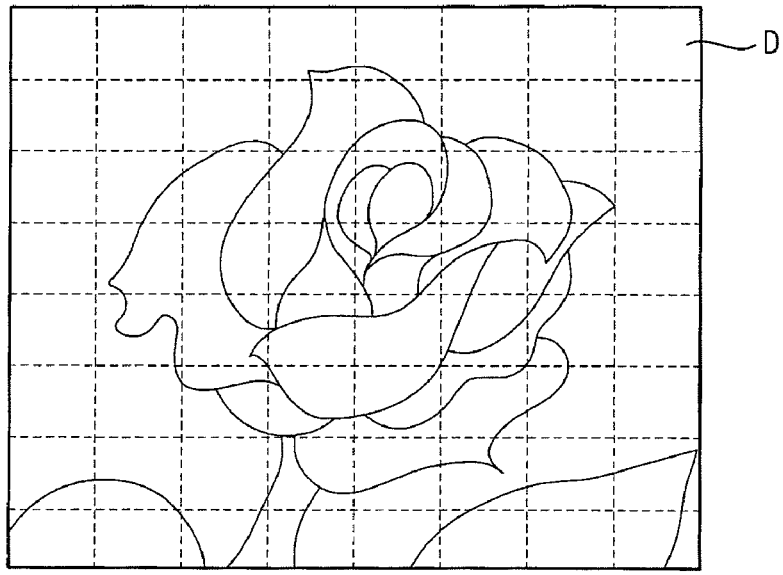
FIG. 6 is a schematic diagram illustrating an image displayed on the display panel of FIG. 1.
Figure 7:
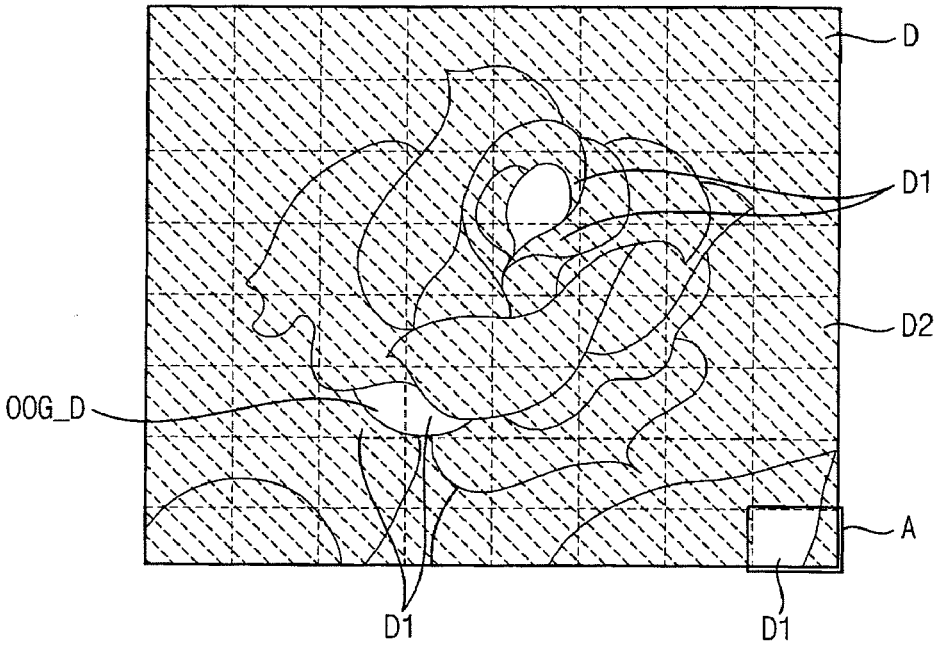
FIG. 7 is a schematic diagram illustrating an OOG area that has an OOG data in the image of FIG. 6.
Figure 8:
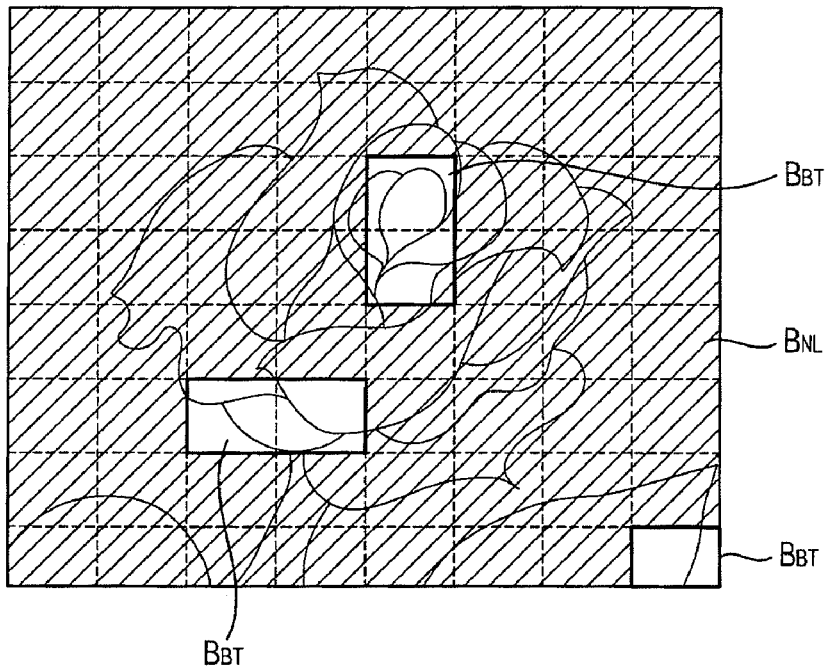
FIG. 8 is a schematic diagram illustrating the light source module corresponding to the image of FIG. 6.
Figure 9:
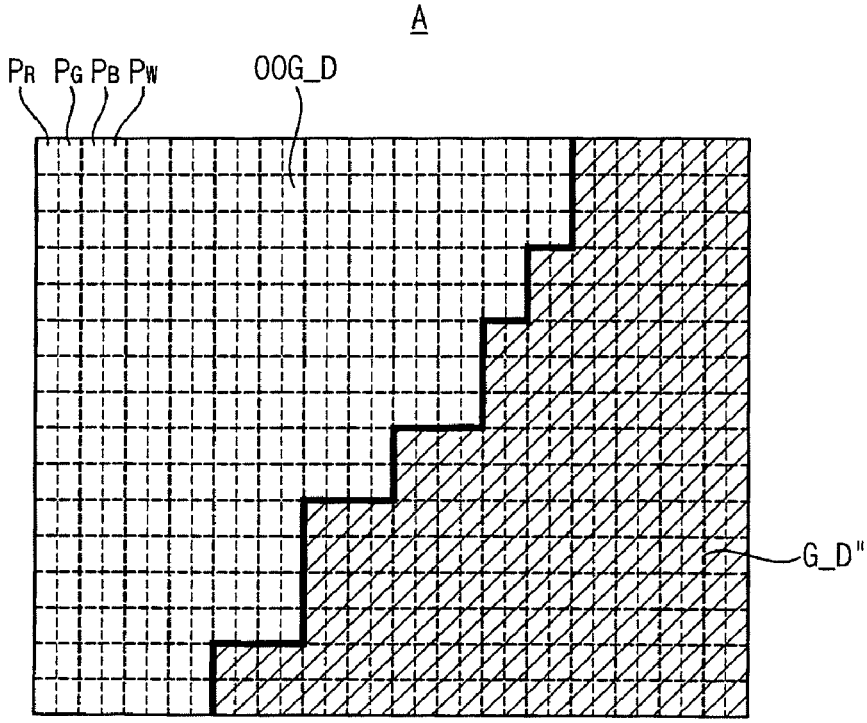
FIG. 9 is an enlarged plan view illustrating the image block "A" of FIG. 7.

FIG. 6 is a schematic diagram illustrating an image displayed on the display panel of FIG. 1. FIG. 7 is a schematic diagram illustrating an OOG area of the image of FIG. 6 having OOG data. FIG. 8 is a schematic diagram illustrating the light source module corresponding to the image of FIG. 6. FIG. 9 is an enlarged plan view illustrating the image block "A" of FIG. 7.

Referring to FIGS. 1, 6 and 7, the OOG determining part 210 compares data of a frame image such as shown FIG. 6 with the reference value, and determines the OOG data OOG_D among the frame images as shown FIG. 7.

Referring to FIGS. 1, 7 and 9, the local dimming driving part 230 distinguishes the first and second image blocks D1 and D2 using information provided from the OOG determining part 210. The first image blocks D1 include the OOG data OOG_D, and the second image blocks, e.g., D2 do not include the OOG data OOG_D.

The local dimming driving part 230 controls the first light-emitting block BBT corresponding to the first image block D1 to boost the first image block D1 to the maximum luminance. The local dimming driving part 230 controls the second light-emitting block BNL corresponding to the second image block D2 to drive the second light-emitting block BNL to have the luminance based on the representative gray-scale of the second image block D2.

The first image block D1 as shown FIG. 9, includes the OOG data OOG_D and the gray-scale. The gray-scale correcting part 130 corrects the gray-scale to the low gray-scale G_D". The low gray-scale G_D" is lower than the original gray-scale substantially in proportion to a luminance increasing ratio of light provided to the first image block D1.

Therefore, the OOG data OOG_D of the first image block D1 may be displayed by using the light boosted to the maximum luminance. The gray-scale of the first image block is corrected to the low gray-scale G_D" so that the gray-scale having the low gray-scale may display an image of an original luminance although light of the maximum luminance is provided to the first image block D1.

Figure 10:
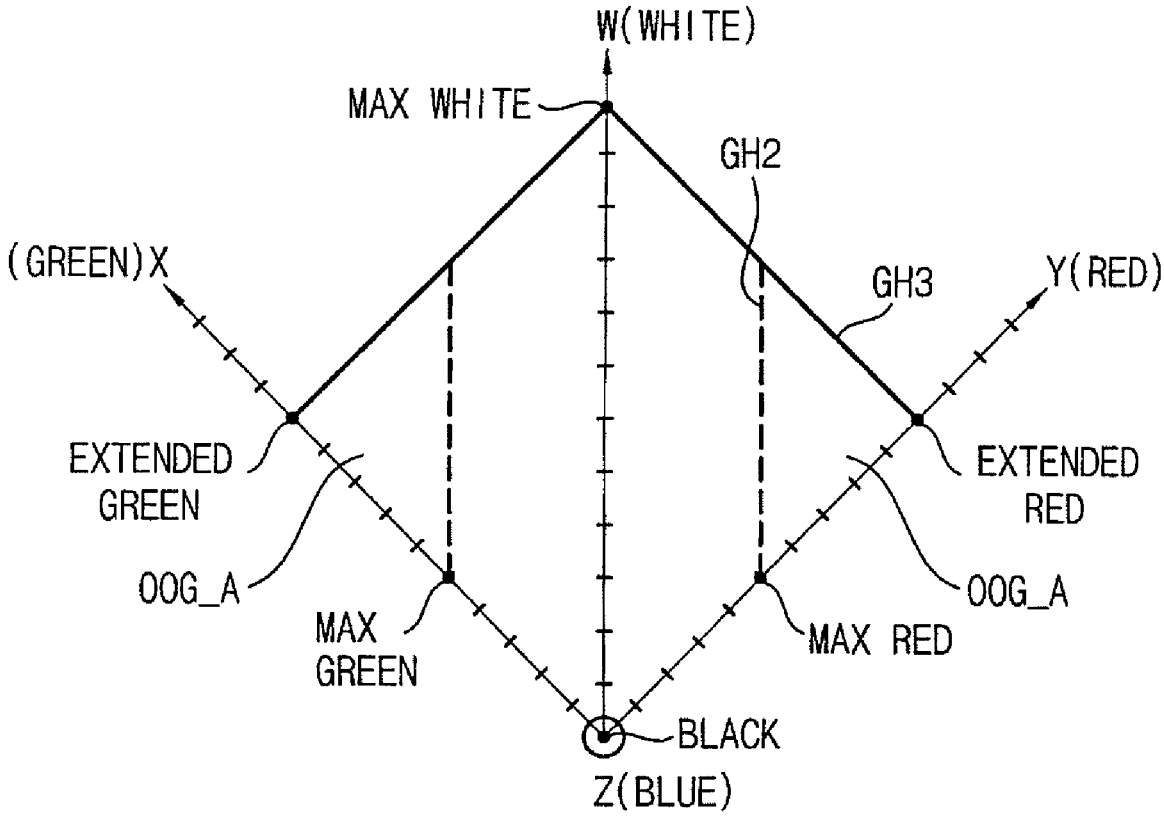
FIG. 10 is a graph illustrating a color area that is displayed in the display apparatus of FIG. 1.

FIG. 10 is a graph illustrating a color area that is displayed by the display apparatus of FIG. 1.

Referring to FIGS. 1 and 10, the display apparatus has the second display area GH2 by the display panel of the RGBW structure. The display apparatus may display the OOG color of the OOG area OOG_A using the light boosted to the maximum luminance provided from the light source apparatus 300.

According to an exemplary embodiment, the display apparatus of the RGBW structure has the third display area GH3 that may be extended by two times (2×) of the display area of the display apparatus of the RGB structure. Also, the display apparatus of the RGBW structure may display the OOG color of the OOG area OOG_A.

According to an exemplary embodiment of the present invention, the OOG color that was not displayed on the display panel of the RGBW structure may be displayed by using light boosted to the maximum luminance so that the display apparatus may enhance the display quality. The display apparatus may enhance the transmissivity and may decrease the power consumption by having the RGBW structure.

The foregoing is illustrative of the present invention and is not to be construed as limiting thereof. Although exemplary embodiments of the present invention have been described, those skilled in the art will readily appreciate that many modifications are possible without materially departing from the scope of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to exemplary embodiments are intended to be included within the scope of the appended claims. The present invention is defined by the following claims, with equivalents of the claims to be included therein.

What is claimed is:

1. A method of individually driving a plurality of light-emitting blocks of a light source module providing light to a display panel including a unit pixel, the method comprising:

boosting luminance of a first light-emitting block corresponding to a first image block among a plurality of image blocks corresponding to the light-emitting blocks upon determining that the first image block includes out of gamut (OOG) data;

driving a second light-emitting block corresponding to a second image block so that the second light-emitting block has luminance corresponding to a representative gray-scale of the second image block upon determining that the second image block does not include OOG data; and correcting gray-scale of the first image block, except for the OOG data, so that an image displayed by the corrected gray-scale has an original, pre-boosted luminance.

2. The method of claim 1, wherein the unit pixel comprises red, green, blue and white pixels and the method further comprises comparing an input data with a reference value to determine whether the input data is OOG data being out of a displayable data range of the display panel, the input data including red, green and blue gray-scales.

3. The method of claim 2, wherein the input data is compared with the reference value based on one of red, green and blue gray-scales and red, green, blue and white gray-scales.

4. The method of claim 1, wherein boosting the first light-emitting block further comprises adjusting a duty ratio of a driving signal that drives the first light-emitting block.

5. The method of claim 1, wherein boosting luminance of the first light-emitting block further comprises adjusting a peak current of a driving signal that drives the first light-emitting block.

6. The method of claim 1, wherein boosting luminance of the first light-emitting block further comprises adjusting a duty ratio and a peak current of a driving signal that drives the first light-emitting block, respectively.

7. A display apparatus comprising:

a light source module including a plurality of light-emitting blocks;

a display panel including a unit pixel that comprises red, green, blue and white pixels, and displaying an image divided into a plurality of image blocks corresponding to the light-emitting blocks;

a light source module driving part boosting luminance of a first light-emitting block corresponding to a first image block among the image blocks, the OOG data being out of a displayable data range of the display panel upon determining that the first light-emitting block includes an out of gamut (OOG) data; and a gray-scale correcting part correcting gray-scale of the first image block, except for the OOG data, so that an image displayed by the corrected gray-scale has an original, pre-boosted, luminance.

8. The display apparatus of claim 7, wherein the light source module driving part drives a second light-emitting block corresponding to a second image block that does not include the OOG data, the second light-emitting block having luminance corresponding to a representative gray-scale of the second image block.

9. The display apparatus of claim 8, wherein the light source module driving part includes:

an OOG determining part comparing an image data with a reference value, and determining whether an input data is the OOG data, the input data including red, green and blue gray-scales;

a light source driving part providing the light-emitting block with driving signals; and a local dimming driving part controlling the light source driving part to boost luminance of the first light-emitting block and luminance of the second light-emitting block corresponds to the representative gray-scale of the second image block.

10. The display apparatus of claim 9, wherein the local dimming driving part increases a duty ratio of a driving signal that drives the first light-emitting block.

11. The display apparatus of claim 9, wherein the local dimming driving part increases a peak current of a driving signal that drives the first light-emitting block.

12. The display apparatus of claim 9, further comprising:

a data converting part that converts the red, green and blue gray-scales to red, green, blue and white gray-scales.

13. The display apparatus of claim 12, wherein the OOG determining part determines whether the input data is the OOG data based on red, green and blue gray-scales.

14. The display apparatus of claim 12, wherein the OOG determining part determines whether the input data is the OOG data based on red, green, blue and white gray-scales.

15. The display apparatus of claim 7, wherein the light source module comprises red, green and blue light sources.

16. The display apparatus of claim 7, wherein the light source module comprises white light sources.

17. A method of driving a display apparatus including a display panel including a unit pixel that comprises red, green, blue and white pixels and a light source module individually driving a plurality of light-emitting blocks, the method comprising:

comparing an input data with a reference value to determine whether the input data is an out of gamut (OOG) data that is out of a displayable data range of the display panel, the input data including red, green and blue gray-scales;

boosting luminance of a first light-emitting block corresponding to a first image block that includes the OOG data among a plurality of image blocks corresponding to the light-emitting blocks;

correcting gray-scale of the first image block, except for the OOG data, so that an image displayed by the corrected gray-scale has an original, pre-boosted, luminance; and displaying the OOG data and the corrected gray-scale of the first image block on the display panel.

18. The method of claim 17, further comprising:

driving a second light-emitting block corresponding to a second image block that does not include the OOG data, the second light-emitting block having luminance corresponding to a representative gray-scale of the second image block; and displaying gray-scales of the second image block on the display panel.

19. The method of claim 17, wherein comparing the input data with the reference value includes:

converting red, green and blue gray-scales to red, green and blue luminance values; and determining the red, green and blue gray-scales of the OOG data when a minimum value among the red, green and blue luminance is lower than a low reference value and a maximum value among the red, green and blue luminance is higher than a high reference value.

* * * * *